US010520856B2

(12) United States Patent
Koike et al.

(10) Patent No.: US 10,520,856 B2
(45) Date of Patent: Dec. 31, 2019

(54) DEVELOPING DEVICE, PROCESS CARTRIDGE, AND IMAGE FORMING APPARATUS INCORPORATING SAME

(71) Applicant: Ricoh Company, Ltd., Tokyo (JP)

(72) Inventors: Toshio Koike, Tokyo (JP); Jun Shiori, Kanagawa (JP); Hideo Yoshizawa, Kanagawa (JP); Keinosuke Kondoh, Kanagawa (JP); Teppei Kikuchi, Kanagawa (JP); Kazuhiro Aso, Kanagawa (JP); Michiharu Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/210,036

(22) Filed: Dec. 5, 2018

(65) Prior Publication Data

US 2019/0219951 A1 Jul. 18, 2019

(30) Foreign Application Priority Data

Jan. 18, 2018 (JP) ..... 2018-006184

(51) Int. Cl.
*G03G 15/09* (2006.01)
*G03G 15/08* (2006.01)

(52) U.S. Cl.
CPC ..... *G03G 15/0921* (2013.01); *G03G 15/0812* (2013.01); *G03G 15/0887* (2013.01); *G03G 15/0942* (2013.01)

(58) Field of Classification Search
CPC ..... G03G 15/09; G03G 15/0887; G03G 15/0896; G03G 15/0898; G03G 15/0942;
(Continued)

(56) References Cited

U.S. PATENT DOCUMENTS

2008/0080906 A1* 4/2008 Kawahara ..... G03G 15/0942 399/277
2015/0055966 A1 2/2015 Matsumoto et al.
(Continued)

FOREIGN PATENT DOCUMENTS

JP 2002-123085 4/2002
JP 2009-036875 2/2009
(Continued)

OTHER PUBLICATIONS

JP 2009036875 English machine translation, Yoshida, Feb. 19, 2009 (Year: 2009).*

*Primary Examiner* — Thomas S Giampaolo, II
(74) *Attorney, Agent, or Firm* — Xsensus LLP

(57) ABSTRACT

A developing device includes a developer bearer opposed to an image bearer, configured to bear developer and rotate in a direction of rotation of the developer bearer, and configured to develop a latent image on the image bearer and a casing opposed to the developer bearer at a position downstream from an opposed position, at which the developer bearer is opposed to the image bearer, in the direction of rotation of the developer bearer. A casing gap between the developer bearer and the casing continuously decreases or increases from a first end of the developing device to a second end of the developing device across a center of the developing device in a longitudinal direction of the developing device.

16 Claims, 8 Drawing Sheets

(58) Field of Classification Search
CPC ..... G03G 15/0921; G03G 21/1676; G03G 2215/0634; G03G 2215/0636; G03G 2215/0872
See application file for complete search history.

(56) References Cited

U.S. PATENT DOCUMENTS

| | | | |
|---|---|---|---|
| 2015/0078788 | A1 | 3/2015 | Koike et al. |
| 2015/0139671 | A1 | 5/2015 | Matsumoto et al. |
| 2015/0227086 | A1 | 8/2015 | Kondoh et al. |
| 2015/0338824 | A1 | 11/2015 | Shimizu et al. |
| 2016/0026113 | A1 | 1/2016 | Takahashi et al. |
| 2016/0223946 | A1 | 8/2016 | Kikuchi et al. |

FOREIGN PATENT DOCUMENTS

| | | |
|---|---|---|
| JP | 2013-025099 | 2/2013 |
| JP | 2016-070993 | 5/2016 |

* cited by examiner

DEVELOPING DEVICE, PROCESS CARTRIDGE, AND IMAGE FORMING APPARATUS INCORPORATING SAME

CROSS-REFERENCE TO RELATED APPLICATION

This patent application is based on and claims priority pursuant to 35 U.S.C. § 119(a) to Japanese Patent Application No. 2018-006184, filed on Jan. 18, 2018, in the Japan Patent Office, the entire disclosure of which is hereby incorporated by reference herein.

BACKGROUND

Technical Field

This disclosure generally relates to an electrophotographic image forming apparatus such as a copier, a printer, a facsimile machine, or a multifunction peripheral (MFP) having at least two of copying, printing, facsimile transmission, plotting, and scanning capabilities, and a developing device and a process cartridge incorporated therein.

Description of the Related Art

There are known image forming apparatuses, such as copiers, printers, and the like, that include a developing device to develop an electrostatic latent image on an image bearer, such as a photoconductor drum, into a toner image. The developing device includes a developing roller (a developer bearer) opposed to the image bearer (the photoconductor drum). The developing roller (the developer bearer) rotates in a predetermined direction, while transporting developer.

SUMMARY

According to embodiments of the present disclosure, an improved developing device includes a developer bearer opposed to an image bearer, configured to bear developer and rotate in a direction of rotation of the developer bearer, and configured to develop a latent image on the image bearer and a casing opposed to the developer bearer at a position downstream from an opposed position, at which the developer bearer is opposed to the image bearer, in the direction of rotation of the developer bearer. A casing gap between the developer bearer and the casing continuously decreases or increases from a first end of the developing device to a second end of the developing device across a center of the developing device in a longitudinal direction of the developing device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
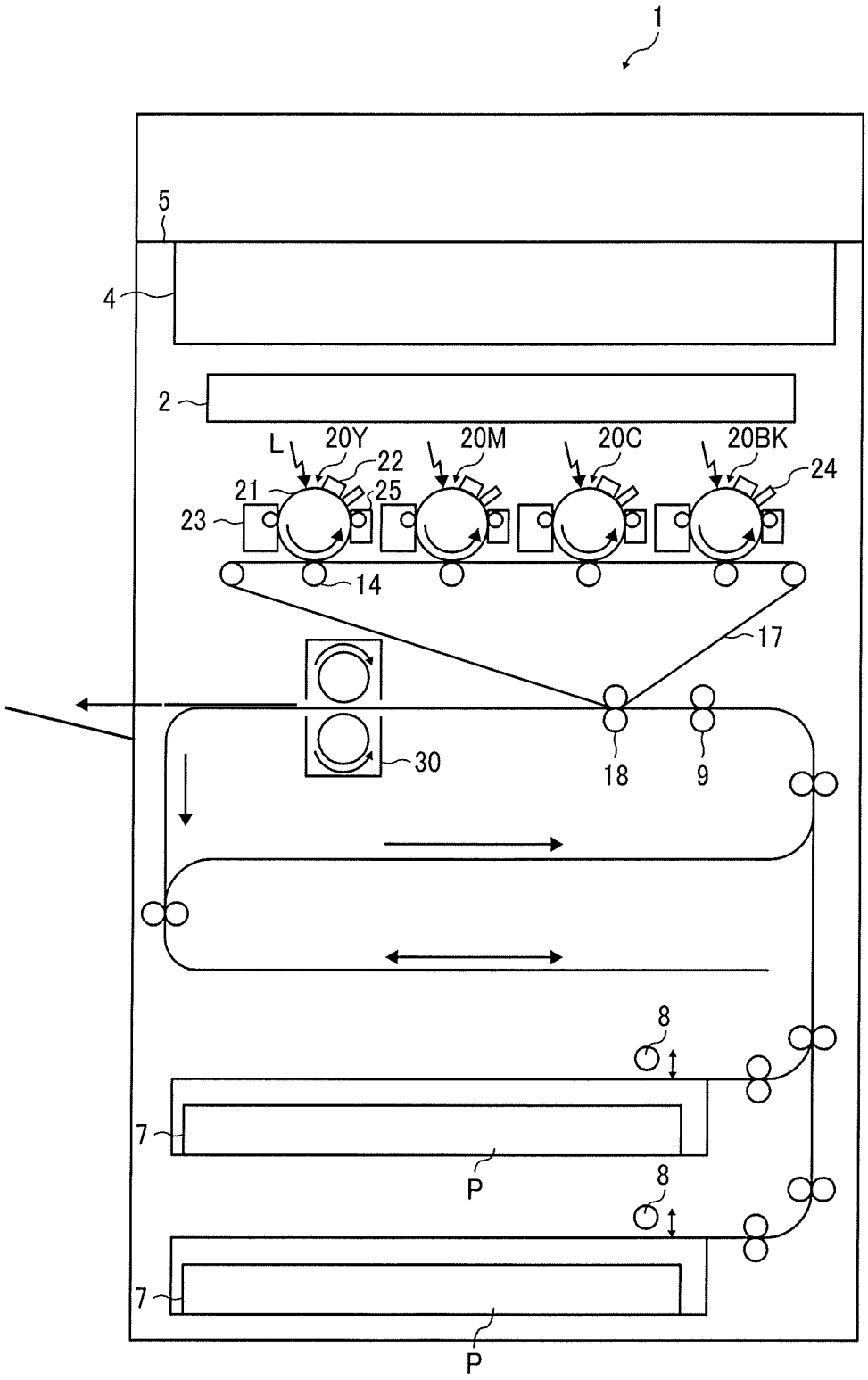
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, and BK attached to each reference numeral indicate only that components indicated thereby are used for forming yellow, magenta, cyan, and black images, respectively, and hereinafter may be omitted when color discrimination is not necessary.

Referring to the drawings, embodiments of the present disclosure are described below. It is to be understood that identical or similar reference numerals are assigned to identical or corresponding components throughout the drawings, and redundant descriptions are omitted or simplified below.

Referring to FIG. 1, a description is provided of a configuration and an operation of the image forming apparatus 1.

In FIG. 1, the image forming apparatus 1, which is a tandem color copier in the present embodiment, includes a writer 2, a document reading device 4, a sheet feeder 7, and a registration roller pair 9. The writer 2 emits a laser beam L based on image data read by the document reading device 4. The document reading device 4 reads the image data of an original document set on an exposure glass 5. The sheet feeder 7 stores sheets P. The registration roller pair 9 (a timing roller pair) adjusts a conveyance timing of the sheets P.

The image forming apparatus 1 further includes a primary transfer roller 14, an intermediate transfer belt 17, and a secondary transfer roller 18. The primary transfer rollers 14 primarily transfer toner images formed on respective photoconductor drums 21 onto the intermediate transfer belt 17 one on another, thereby forming a multicolor toner image. The secondary transfer roller 18 secondarily transfers the multicolor toner image on the intermediate transfer belt 17 onto a sheet P.

The image forming apparatus 1 yet further includes process cartridges 20Y, 20M, 20C, and 20BK (image forming units) to form respective (yellow, magenta, cyan and black) toner images on respective surfaces of the photoconductor drums 21 as image bearers included in the process cartridges 20Y, 20M, 20C, and 20BK.

A charger 22, a developing device 23, a discharger 24, and a cleaner 25 are disposed around each photoconductor drum 21. The charger 22 charges a surface of the photoconductor drum 21, the developing device 23 develops an electrostatic latent image formed on the surface of the photoconductor drum 21, the discharger 24 eliminates a surface potential of the photoconductor drum 21, and the cleaner 25 collects untransferred toner remaining on the surface of the photoconductor drum 21. A fixing device 30 fixes the toner image (unfixed image) secondarily transferred onto the sheet P.

Figure 2:
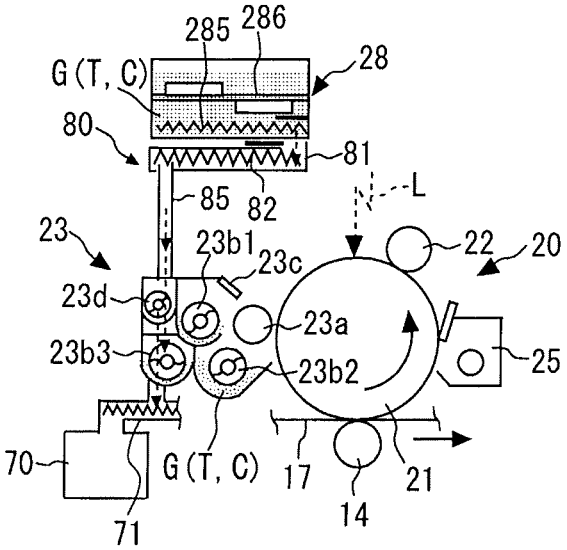
FIG. 2 is a schematic view illustrating an image forming portion according to an embodiment of the present disclosure.

Additionally, a developer supply unit is disposed above each of the process cartridges 20Y, 20C, 20M, and 20BK. The developer supply unit includes a developer container 28 containing yellow, cyan, magenta, or black developer to be supplied to the developing device 23 and a developer supply device 80 as illustrated in FIG. 2. In the present embodiment, two-component developer including toner and carrier is used.

A description is provided of image forming processes of the image forming apparatus 1 to form the multicolor toner image.

It is to be noted that FIG. 2 is also referred to when image forming processes performed by the process cartridges 20Y, 20M 20C, and 20BK are described. The document reading device 4 reads the image data of the original document set on the exposure glass 5 optically. More specifically, the document reading device 4 scans the image on the original document on the exposure glass 5 with light emitted from an illumination lamp. The light reflected from a surface of the original document is imaged on a color sensor via mirrors and lenses. Multicolor image data of the original document is decomposed into red, green, and blue (RGB), read by the color sensor, and converted into electrical image signals. Further, an image processor performs image processing (e.g., color conversion, color calibration, and spatial frequency adjustment) according to the RGB color separation image signals, and thus color image data of yellow, magenta, cyan, and black are obtained.

The yellow, magenta, cyan, and black image data are sent to the writer 2. The writer 2 irradiates the photoconductor drums 21 with laser beams L according to the yellow, magenta, cyan, and black image data, respectively.

Meanwhile, the four photoconductor drums 21 rotate counterclockwise in FIGS. 1 and 2. The surface of the photoconductor drum 21 is uniformly charged by the charger 22 at a position facing the charger 22 (a charging process). The surface of the photoconductor drum 21 is charged to a charging potential. Subsequently, the surface of the photoconductor drum 21 thus charged reaches a position to receive the laser beam L.

The writer 2 emits four laser beams L corresponding to respective color image data from four light sources. The four laser beams L pass through respective optical paths for yellow, magenta, cyan, and black (an exposure process).

The laser beam L corresponding to the yellow component is directed to the surface of photoconductor drum 21 in the process cartridge 20Y, which is the first from the left in FIG. 1 among the four process cartridges 20Y, 20M, 20C, and 20BK. At that time, a polygon mirror rotates at high speed to deflect the laser beam L having the yellow component in a direction of rotational axis of the photoconductor drum 21 (i.e., a main-scanning direction or a longitudinal direction of the photoconductor drum 21) so as to scan the photoconductor drum 21. Thus, an electrostatic latent image having the yellow component is formed on the photoconductor drum 21 charged by the charger 22.

Similarly, the laser beam L corresponding to the magenta component is emitted to the surface of the photoconductor drum 21 in the second process cartridge 20M from the left in FIG. 1. Consequently, an electrostatic latent image having the magenta component is formed on the surface of the photoconductor drum 21. The laser beam L corresponding to the cyan component is directed to the photoconductor drum 21 in the third process cartridge 20C from the left in FIG. 1, thus forming an electrostatic latent image having the cyan component on the surface of the photoconductor drum 21. The laser beam L corresponding to the black component is directed to the photoconductor drum 21 in the fourth process cartridge 20BK from the left in FIG. 1, thus forming an electrostatic latent image having the black component on the surface of the photoconductor drum 21.

Then, the respective surfaces of the photoconductor drums 21 having the respective electrostatic latent images reach positions facing the developing devices 23. The developing device 23 supplies toner of each color onto the surface of the photoconductor drum 21 and develops the electrostatic latent image formed on the surface of the photoconductor drum 21 into a visible toner image (a developing process).

Specifically, an amount of developer G, which is scooped up by magnetic force of a magnetic pole of a developing roller 23*a*, is adjusted by a doctor blade 23*c*, and the developer G is transported to a development range where the developing roller 23*a* is opposed to the photoconductor drum 21 with reference to FIG. 2. In the development range, carrier C (the developer G) standing on end slidingly contacts the photoconductor drum 21. At that time, toner T mixed with the carrier C is charged negatively by friction with the carrier C. On the other hand, the carrier C is charged positively. A predetermined developing bias is applied to the developing roller 23*a* from a power source. Thus, an electric field is formed between the developing roller 23*a* and the photoconductor drum 21, and the toner T negatively charged is selectively adhered to images on the photoconductor drum 21, thereby forming toner images. The developer G moves along with rotation of the developing roller 23*a*, separates from the developing roller 23*a*, and returns to the developing device 23 (a second conveyance compartment B2).

Subsequently, the surface of the photoconductor drum 21 after the developing process reaches a position facing the intermediate transfer belt 17. Primary transfer rollers 14 are provided in contact with an inner circumferential surface of the intermediate transfer belt 17 at the positions where the respective photoconductor drums 21 are opposed to the intermediate transfer belt 17. At the positions of the primary transfer rollers 14, the respective toner images on the photoconductor drums 21 are sequentially transferred and superimposed onto the intermediate transfer belt 17 (a primary transfer process).

After the primary transfer process, the surface of the photoconductor drum 21 reaches a position facing the cleaner 25. The cleaner 25 collects untransferred toner remaining on the photoconductor drum 21 (a cleaning process).

Additionally, the surface of the photoconductor drum 21 passes through the discharger 24, and a series of image forming processes performed on the photoconductor drum 21 is completed.

The multicolor toner image is formed on the intermediate transfer belt 17 by transferring and overlaying the respective single-color toner images formed on the photoconductor drums 21. Then, the intermediate transfer belt 17 moves in a clockwise direction in FIG. 1 to reach a position facing the secondary transfer roller 18. The multicolor toner image borne on the intermediate transfer belt 17 is transferred onto a sheet P at the position facing the secondary transfer roller 18 (a secondary transfer process).

After the secondary transfer process, the surface of the intermediate transfer belt 17 reaches a position facing a belt cleaner. The belt cleaner collects untransferred toner adhering to the intermediate transfer belt 17, and a series of transfer processes on the intermediate transfer belt 17 is completed.

The sheet P is conveyed to a secondary transfer nip formed between the intermediate transfer belt 17 and the secondary transfer roller 18, via the registration roller pair 9 from the sheet feeder 7.

More specifically, a sheet feed roller 8 feeds the sheet P from top of multiple sheets P accommodated in the sheet feeder 7, and conveyance roller pairs convey the sheet P to the registration roller pair 9. The sheet P that has reached the registration roller pair 9 is conveyed toward the secondary transfer nip, timed to coincide with the multicolor toner image on the intermediate transfer belt 17.

Consequently, the sheet P having the multicolor image on the sheet P is guided by a conveyance belt to the fixing device 30. The fixing device 30 includes a fixing roller and a pressure roller pressing against each other. A heat source such as a heater is provided inside the fixing roller, and the multicolor image is fused and fixed on the sheet P in a nip between the fixing roller and the pressure roller (a fixing process).

After the fixing process, an ejection roller discharges the sheet P as an output image outside the image forming apparatus 1. Thus, a series of image forming processes is completed.

Referring to FIGS. 2 to 4B, the process cartridge 20 (the image forming unit), the developer container 28, and the developer supply device 80 are described below.

It is to be noted that the process cartridges 20Y, 20C, 20M, and 20BK are similar in configuration and the developer containers 28 and the developer supply devices 80 are similar in configuration among different colors, and thus the suffixes Y, C, M, and BK are omitted in FIG. 2.

As illustrated in FIG. 2, the process cartridge 20 as a single unit includes the photoconductor drum 21 as the image bearer, the charger 22, the developing device 23, and the cleaner 25 and employs a premix development method in which carrier C is appropriately supplied and discharged.

The photoconductor drum 21 as the image bearer in the present embodiment is a negatively-charged organic photoconductor and is rotated counterclockwise in FIG. 2 by a driving unit.

The charger 22 is an elastic charging roller and can be formed by covering a core with an elastic layer of moderate resistivity, such as foamed urethane layer, that includes carbon black as conductive particles, sulfuration agent, foaming agent, and the like. The material of the elastic layer of moderate resistivity of the charger 22 includes, but not limited to, rubber such as urethane, ethylene-propylene-diene-polyethylene (EPDM), acrylonitrile butadiene rubber (NBR), silicone rubber, and isoprene rubber to which conductive material such as carbon black or metal oxide is added to adjust the resistivity. Alternatively, foamed rubber including these materials may be used. Although the charging roller as the charger 22 is used in the present embodiment, alternatively, a wire charger employing a corona discharge is used as the charger 22 in another embodiment.

The cleaner 25 includes a cleaning blade that slidingly contacts the photoconductor drum 21 and mechanically removes untransferred toner on the photoconductor drum 21.

The untransferred toner collected in the cleaner 25 is transported by a conveyance coil outside the cleaner 25 and collected in a waste toner container 70 via a conveyance pipe 71.

The developing device 23 includes the developing roller 23*a*, serving as a developer bearer, disposed close to the photoconductor drum 21 through an opening of a casing of the developing device 23, and a developing range where a magnetic brush formed on the developing roller 23*a* contacts the photoconductor drum 21 is formed in an opposed position where the developing roller 23*a* is opposed to the photoconductor drum 21. The developing device 23 contains two-component developer G including toner T and carrier C. The two-component developer G further includes additives. The developing device 23 develops the electrostatic latent image on the photoconductor drum 21 into a toner image.

In the present embodiment, the developing device 23 employs the premix development method, and fresh developer G (toner T and carrier C) is supplied from the developer container 28 via the developer supply device 80, and degraded developer G (i.e., carrier C mainly) is discharged outside the developing device 23 through an outlet, transported through the conveyance pipe 71, and collected in the waste toner container 70, in which the above-described wasted toner is also collected.

Referring to FIG. 2, the developer container 28 contains developer G (toner T and carrier C) to be supplied to the developing device 23. The developer container 28 supplies fresh toner T and fresh carrier C to the developing device 23. Specifically, in one embodiment, based on the percentage of toner Tin developer G (or toner density) detected by a magnetic sensor of the developing device 23, a conveying screw 82 of the developer supply device 80 is driven, thereby transporting the developer G from a reservoir 81 to a downward passage 85. Then, the developer G falls though the downward passage 85 to the developing device 23 by the own weight. The magnetic sensor is disposed in a third conveyance compartment B3.

It is to be noted that, referring to FIG. 2, the developer container 28 in the present embodiment is substantially box-shaped and includes a shutter to open and close an outlet, a conveying screw 285, and an agitator 286.

The developer container 28 is removably installed in the developer supply device 80 (the image forming apparatus 1) in a substantially horizontal direction by a manual operation of a user. The outlet of the developer container 28 opens downward in the bottom of the developer container 28 to discharge developer G from the developer container 28 to the reservoir 81 of the developer supply device 80. The shutter of the developer container 28 moves in the direction in which the developer container 28 is installed in and removed from the developer supply device 80 to open and close the outlet.

A configuration and operation of the developing device 23 are described below.

Figure 3:
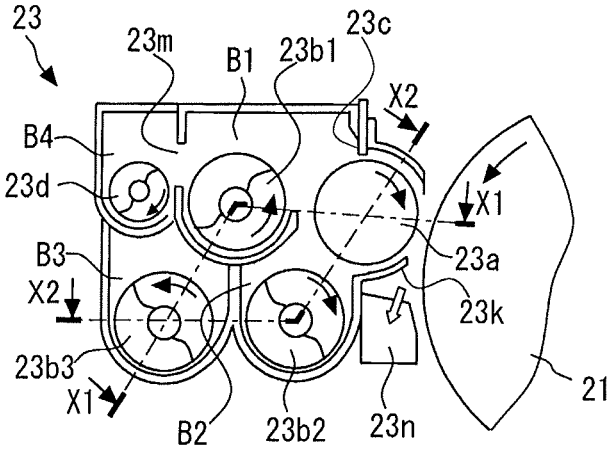
FIG. 3 is an enlarged view of a developing device according to an embodiment of the present disclosure.
Figure 4A:
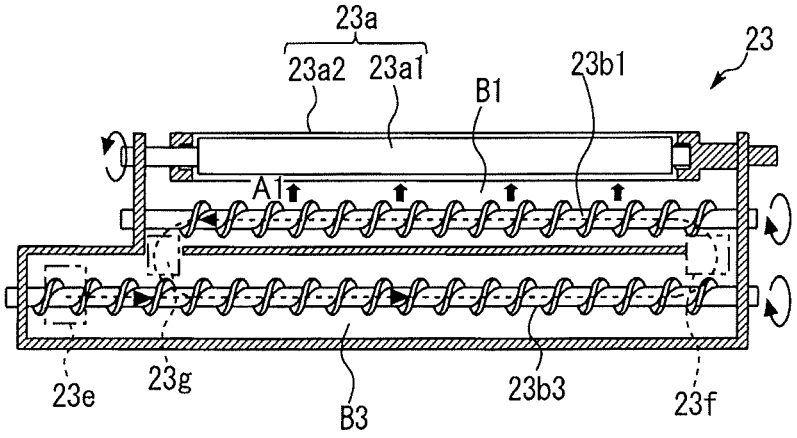
FIGS. 4A and 4B are schematic cross-sectional views of the developing device along lines X1-X1 and X2-X2 illustrated in FIG. 3, respectively.
Figure 4B:
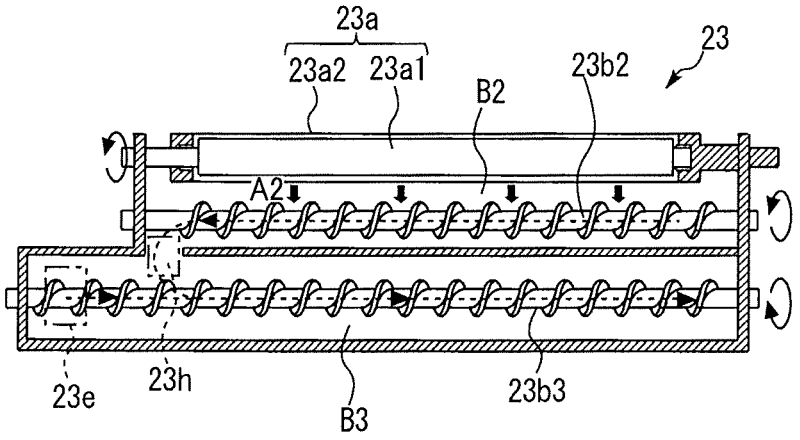

With reference to FIGS. 3, 4A, and 4B, the developing device 23 includes the developing roller 23*a* as the developer bearer, three conveying screws 23*b*1 to 23*b*3 as a conveyor, the doctor blades 23*c* as a developer regulator, a discharge screw 23*d*, and a suction device 23*n*. A first conveyance compartment B1, a second conveyance compartment B2, and a third conveyance compartment B3 (i.e., a supply compartment, a collection compartment, and a stirring compartment) are disposed in the developing device 23 to circulate developer G. Further, a discharge compartment B4 is disposed in the developing device 23 to discharge surplus developer G outside the developing device 23 as appropriate. The developing roller 23*a* includes a cylindrical sleeve 23*a*2 made of a nonmagnetic material and rotates clockwise in FIGS. 2 and 3 by a driving unit. The nonmagnetic material includes, but not limited to, aluminum, brass, stainless steel, and conductive resin. Magnets 23*a*1 secured inside the sleeve 23*a*2 of the developing roller 23*a* generate magnetic fields to cause the developer G to stand on end on the circumferential surfaces of the sleeve 23*a*2. Along magnetic force lines arising from the magnets 23*a*1 in a normal direction, the carrier C in the developer G stands on end on the sleeve 23*a*2, in a chain shape. The toner T adheres to the carrier C standing on end in the chain shape, thus forming the magnetic brush. As the sleeve 23*a*2 rotates, the magnetic brush is transported in the direction of rotation of the sleeve 23*a*2 (clockwise in FIGS. 2 and 3).

The doctor blade 23*c* as the developer regulator is opposed to the developing roller 23*a* upstream from the development range, where the developing roller 23*a* is opposed to the photoconductor drum 21, in a direction of rotation of the developing roller 23*a* (hereinafter, referred to as "rotation direction") to adjust the amount of the developer G on the developing roller 23*a*.

A first conveying screw 23*b*1, a second conveying screw 23*b*2, and a third conveying screw 23*b*3 include a shaft and a helical blade disposed on the shaft and stir developer G contained in the developing device 23 while circulating the developer G in a longitudinal direction of the developing device 23 (hereinafter, also referred to as "developer conveyance direction"), which is perpendicular to the surface of the paper on which FIG. 3 is drawn and the left-right direction in FIGS. 4A and 4B (identical to the axial direction of the developing roller 23*a*).

The first conveying screw 23*b*1 as a first conveyor is opposed to the developing roller 23*a* and supplies developer G to the developing roller 23*a* while transporting the developer G in the longitudinal direction of the developing device 23. The second conveying screw 23*b*2 as a second conveyor is disposed below the first conveying screw 23*b*1, facing the developing roller 23*a* and the first conveying screw 23*b*1. The second conveying screw 23*b*2 transports a portion of the developer G that has been supplied to and separated from the developing roller 23*a* (the developer G after the developing process) in the longitudinal direction from one end (i.e., a first end) to the other end (i.e., a second end) of the developing device 23. The third conveying screw 23*b*3 as a third conveyor transports the developer G flowed into the third conveyance compartment B3 via a third communicating opening 23*h* by the second conveying screw 23*b*2 to an upstream side of the first conveyance compartment B1 in the developer conveyance direction.

In the present embodiment, rotation axes of the first conveying screw 23*b*1 (the first conveyance compartment B1), the second conveying screw 23*b*2 (the second conveyance compartment B2), the third conveying screw 23*b*3 (the third conveyance compartment B3), and a discharge screw 23*d* (the discharge compartment B4) to be describe later are parallel to the horizontal direction, similarly to the developing roller 23*a*.

The first, second, and third conveying screws 23*b*1 to 23*b*3, the developing roller 23*a*, and the discharge screw 23*d* to be described later are driven by a driving unit that rotates the developing roller 23*a* via a gear train and rotated in rotation directions indicated by arrow in FIG. 3.

More specifically, inner walls of the developing device 23 partly separate the first conveyance compartment B1, in which the first conveying screw 23*b*1 transports the developer G, the second conveyance compartment B2, in which the second conveying screw 23*b*2 transports the developer G, and the third conveyance compartment B3, in which the third conveying screw 23*b*3 transports the developer G, from each other. A downstream side of the third conveyance compartment B3 communicates with the upstream side of the first conveyance compartment B1 via a first communicating opening 23*f* in the developer conveyance direction. A downstream side of the first conveyance compartment B1 communicates with an upstream side of the third conveyance compartment B3 via a second communicating opening 23*g*, through which the developer G falls downward, in the developer conveyance direction. A downstream side of the second conveyance compartment B2 communicates with the upstream side of the first conveyance compartment B1 via the third communicating opening 23*h* in the developer conveyance direction. The developer G is delivered from one conveyance compartment to another conveyance compartment via the first, second, or third communicating openings 23*f*, 23*g*, or 23*h*.

In the present embodiment, the first conveying screw 23*b*1 has a screw diameter of 22 mm and a screw pitch of 50 mm with double-thread. The second conveying screw 23*b*2 and the third conveying screw 23*b*3 have a screw diameter of 22 mm and a screw pitch of 25 mm with single-thread.

It is to be noted that a paddle or a screw winding in the opposite direction may be provided to a downstream portion of the first, second, and third conveying screws 23*b*1 to 23*b*3 to facilitate conveyance of the developer G through the first, second, and third communicating openings 23*f*, 23*g*, and 23*h*.

Referring to FIG. 4B, a supply port 23*e* is disposed above the third conveyance compartment B3 (or on the ceiling of the third conveyance compartment B3). The supply port 23*e* communicates with the developer container 28 and the developer supply device 80 included in the developer supply unit to supply fresh toner T and carrier C.

Such a configuration provides a circulation passage through which the developer G is circulated in the longitudinal direction of the developing device 23 by the first, second, and third conveying screws 23*b*1, 23*b*2, and 23*b*3 in the first, second, and third conveyance compartment B1, B2, and B3.

Specifically, referring to FIG. 4A, the first conveying screw 23*b*1 supplies the developer G to the developing roller 23*a* as indicated by arrow A1 while transporting the developer G from right to left in FIG. 4A in the longitudinal direction (horizontal direction) in the first conveyance compartment B1. The developer G that gathers and heaps at the downstream side of the third conveyance compartment B3 is supplied to (flows into) the upstream side of the first conveyance compartment B1 via the first communicating opening 23*f* in the developer conveyance direction. The developer G in the downstream side of the first conveyance compartment B1 falls into the upstream side of the third conveyance compartment B3 in the developer conveyance direction via the second communicating opening 23*g* by the own weight, thereby being supplied to (flowing into) the third conveyance compartment B3.

Referring to FIG. 4B, the second conveying screw 23*b*2 transports the developer G separated from the developing roller 23*a* as indicated by arrow A2, from right side of the second conveyance compartment B2 (the first end of the developing device 23) to left side of the second conveyance compartment B2 (the second side of the developing device 23) in the longitudinal direction (horizontal direction) of the developing device 23. The developer G in the downstream side of the second conveyance compartment B2 is supplied to (flows into) the upstream side of the third conveyance compartment B3 via the third communicating opening 23*h* in the developer conveyance direction.

Referring to FIGS. 4A and 4B, the developer G is supplied to (flows into) the upstream side of the third conveyance compartment B3, from the first conveyance compartment B1 via the second communicating opening 23*g* and from the second conveyance compartment B2 via the third communicating opening 23*h*. The developer G that flows through the second and third communicating openings 23*g* and 23*h* contains fresh developer G appropriately supplied from the supply port 23*e*. The third conveying screw 23*b*3 transports the developer G from left to right in FIGS. 4A and 4B in the longitudinal direction (horizontal direction) of the developing device 23 in the third conveyance compartment B3, and the developer G in the downstream side of the third conveyance compartment B3 is supplied to (flows into) the first conveyance compartment B1 via the first communicating opening 23*f*.

Referring to FIG. 3, a discharge port 23*m* is disposed on a wall of the first conveyance compartment B1 (a wall of conveyance compartment including one of the plurality of conveyors) to discharge the developer G exceeding a predetermined height to the discharge compartment B4.

The discharge compartment B4 is disposed extending along the longitudinal direction of the developing device 23 and facing the developing roller 23*a* across the first conveyance compartment B1. A discharge screw 23*d* as a discharge conveyor is disposed in the discharge compartment B4. The discharge screw 23*d* transports the developer G discharged through the discharge port 23*m* into the discharge compartment B4 and discharges the developer G to the outside of the developing device 23 through the outlet disposed at a downstream side of the discharge compartment B4 in the developer conveyance direction. The discharge screw 23*d* includes a screw shaft and a helical blade winding around the screw shaft, and a rotation axis of the discharge screw 23*d* is parallel to the horizontal direction, similarly to the first, second, and third conveying screws 23*b*1 to 23*b*3. In the present embodiment, the discharge screw 23*d* has a screw diameter in the range of 5 to 22 mm and a screw pitch in the range of 5 to 25 mm with single-thread.

More specifically, the discharge port 23*m* is disposed upstream from the second communicating opening 23*g* at the downstream side of the first conveyance compartment B1 in the developer conveyance direction and on the vertically standing wall that separates the first conveyance compartment B1 and the discharge compartment B4.

The discharge port 23*m* is a substantially rectangular through-hole. The surplus developer G is discharged to the discharge compartment B4 through the discharge port 23*m* when the developer supply device 80 replenishes fresh developer G to the developing device 23, the amount of the developer G in the developing device 23 increases, and an upper surface of the developer G exceeds the predetermined height. The discharge screw 23*d* transports the surplus developer G discharged to the discharge compartment B4 in the longitudinal direction of the developing device 23 and discharges the surplus developer G to the outside of the developing device 23 through the outlet. The developer G discharged from the outlet falls into the conveyance pipe 71 through a downward passage. Then the developer G is transported by a conveying coil disposed in the conveyance pipe 71 and collected in the waste toner container 70 as wasted developer.

Thus, degraded carrier C (developer G) contaminated with resin base or additives of toner T is automatically discharged from the developing device 23. Accordingly, degradation of image quality over time is inhibited.

In the image forming apparatus 1 according to the present embodiment, for example, a linear velocity of image forming process is set to approximately 400 mm/s. Additionally, the development gap between the developing roller 23*a* and the photoconductor drum 21 has a size of about 0.3 mm. The sleeve 23*a*2 of the developing roller 23*a* made of aluminum or stainless steel has an outer diameter of 25 mm. The surface of the sleeve 23*a*2 has multiple V-shaped grooves formed at intervals in the rotation direction of the developing roller 23*a*. Alternatively, the surface of the developing roller 23*a* may be sandblasted.

The configuration and operation of the developing device 23 according to the present embodiment are described in further detail below.

As described above with reference to FIGS. 2 to 4B, the developing device 23 according to the present embodiment includes the developing roller 23*a* facing photoconductor drum 21 as the image bearer. The developing roller 23*a* as the developer bearer bears developer G and rotates in a predetermined rotation direction, thereby transporting the developer G.

Figure 5:
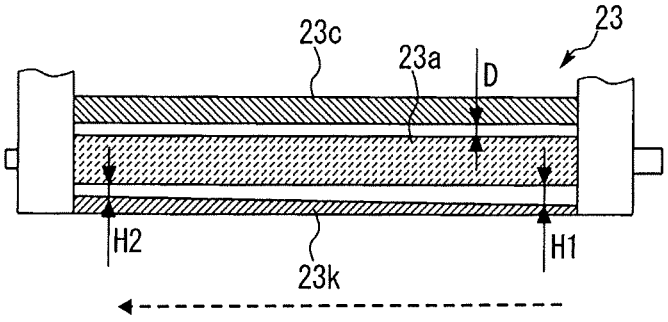
FIG. 5 is a schematic view illustrating a developing roller, a lower casing, and a doctor blade of the developing device, viewed along a longitudinal direction of the developing device.

As illustrated in FIG. 5, in the developing device 23 according to the present embodiment, a gap D between the developing roller 23*a* (the developer bearer) and the doctor blade 23*c* (the developer regulator) is approximately constant across the longitudinal direction of the developing device 23. The gap D is referred to as "a doctor gap" as appropriate. The doctor gap is adjusted to about 0.3 mm so that the amount of the developer G transported on the developing roller 23*a* after passing through the doctor gap, which is the amount of developer scooped, becomes about 38 mg/cm$^2$.

In the developing device 23 as illustrated in FIG. 3, a lower casing 23*k* as a casing is opposed to the developing roller 23*a* at a position downstream from the developing range (i.e., the opposed position), in which the developing roller 23*a* is opposed to the photoconductor drum 21, in the rotation direction of the developing roller 23*a*. The lower casing 23*k* functions as a part of a housing of the developing device 23 and covers a lower portion of the developing roller 23*a* at the position downstream from the development range in the rotation direction of the developing roller 23*a*. In the present embodiment, the lower casing 23*k* is separable from the housing of the developing device 23. Alternatively, the lower casing 23*k* can be constructed with the part of the housing or the entire housing of the developing device 23 as a single piece.

Referring to FIG. 5, in the developing device 23 according to the present embodiment, a gap between the developing roller 23*a* (the developer bearer) and the lower casing 23*k* (the casing) continuously decreases from the first end of the developing device 23 to the second end of the developing device 23 across a center of the developing device 23 in the longitudinal direction of the developing device 23. The gap between the developing roller 23*a* and the lower casing 23*k* is referred to as "a casing gap" as appropriate. In other words, the casing gap is formed with a continuous deviation in the longitudinal direction of the developing device 23.

Specifically, the casing gap H1 at the right side in FIG. 5 (the first end of the developing device 23 in the longitudinal direction) is greater than the casing gap H2 at the left side in FIG. 5 (the second end of the developing device 23 in the longitudinal direction), that is, H1>H2. The face of the lower casing 23*k* that is opposite to the developing roller 23*a* is formed so that the casing gap gradually decreases from right to left in FIG. 5. Note that, in FIG. 5 (and in FIGS. 11 and 12 to be described later), dimension lines indicating the casing gaps H1 and H2 are shifted from end positions to the center side for ease of understanding drawings.

With such a configuration, the developing roller 23*a* hardly receives cyclic force by the developer G transported on the developing roller 23*a* in the casing gap between the developing roller 23*a* and the lower casing 23*k*, thereby minimizing cyclic deviation (vibration) of the developing roller 23*a*. Specifically, when the developer G transported on the developing roller 23*a* passes through the casing gap downstream from the development range, frequencies of stagnation and discharge of the developer G changes in the longitudinal direction. Therefore, timings at which the developer G presses the developing roller 23*a* are dispersed, thereby reducing the vibration of the developing roller 23*a*.

As a result, a problem is prevented that cyclic density difference (horizontal band with pitch) occurs in images formed on the photoconductor drum 21 due to the cyclic change of the development gap between the developing roller 23*a* and the photoconductor drum 21.

In the present embodiment, the casing gap continuously decreases from the first end of the developing device 23 (right side in FIG. 5) to the second end of the developing device 23 (left side in FIG. 5) across the center of the developing device 23 in the longitudinal direction of the developing device 23. Alternatively, the casing gap may continuously increase from the first end of the developing device 23 (right side in FIG. 5) to the second end of the developing device 23 (left side in FIG. 5) across the center of the developing device 23 in the longitudinal direction of the developing device 23, thereby attaining similar effects described above.

More specifically, descriptions are provided of a mechanism to reduce the vibration of the developing roller 23*a* by continuous deviation (slope) of the casing gap with reference to FIG. 6.

FIGS. 6A, 6C, 6E, and 6G are cross-sectional views illustrating motions of the developer G transported on the developing roller 23*a* near the casing gap in order of motion. FIGS. 6B, 6D, 6F, and 6H are schematic views illustrating the developer G in the casing gap viewed along the longitudinal direction of the developing device 23, corresponding to FIGS. 6A, 6C, 6E, and 6G respectively. FIGS. 7A to 7H are described later in similar manner in FIGS. 6A to 6H.

In FIGS. 6A, 6C, 6E, and 6G (and FIGS. 7A, 7C, 7E, and 7G), the magnetic pole of the developing roller 23*a* acts on the developer G to form the magnetic brush of the developer G so that the magnetic brush slidingly contacts the lower casing 23*k* in areas enclosed by dashed lines. A suction airflow is generated that sucks air around the magnetic brush of the developer G in the casing gap into the developing device 23, and scattering toner near the development range is collected into the developing device 23 by a pumping effect. The pumping effect by the magnetic brush of the developer G in the casing gap prevents toner scattering in the developing device 23 from erupting to the outside of the developing device 23.

In FIGS. 6B, 6D, 6F, and 6H (and FIGS. 7B, 7D, 7F, and 7H), the casing gap is divided into three ranges M1 to M3 in the longitudinal direction of the developing device 23 for convenience of explanation.

Figure 6A:
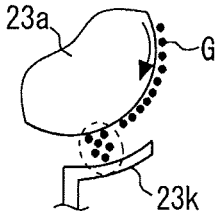
FIGS. 6A to 6H are schematic views illustrating motions of developer passing through a casing gap of the developing device according to an embodiment of the present disclosure.
Figure 6B:
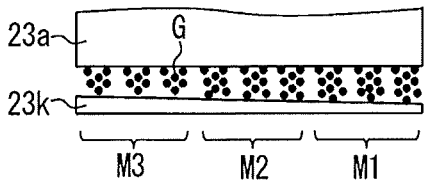
Figure 6C:
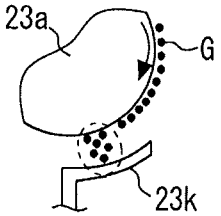
Figure 6D:
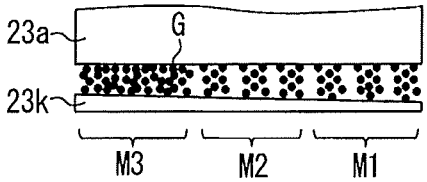

As illustrated in FIGS. 6A and 6B, the developer G does not fully accumulate in the casing gap immediately after the developing device 23 starts operation. As illustrated in FIGS. 6C and 6D, as the developer G is transported to the casing gap by the developing roller 23*a*, the amount of the developer G in the casing gap is saturated in the range M3 having narrowest casing gap. This is because that the casing gap is narrow, and a volume of the casing gap is small. However, the developer G accumulated in the casing gap is not saturated in the ranges M1 and M2 because the casing gaps in the ranges M1 and M2 are greater than the casing gap in the range M3. Accordingly, pressure in the casing gap, with which the developer G presses the developing roller 23*a*, increases in the range M3 but does not increase in the ranges M1 and M2.

Figure 6E:
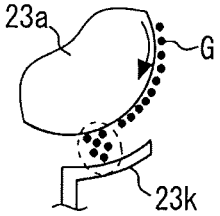
Figure 6F:
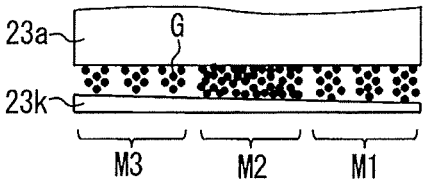

As illustrated in FIGS. 6E and 6F, as the developing roller 23*a* further transports the developer G, the amount of the developer G in the casing gap is saturated in the range M2 having second narrowest casing gap at a timing different from the range M3. At that time, the developer G saturated in the casing gap is discharged (collected) into the developing device 23 in the range M3, and the pressure in the casing gap decreases. In addition, the amount of the developer G in the casing gap is not yet saturated in the range M1. Accordingly, the pressure in the casing gap increases in the range M2 but does not increase in the ranges M1 and M3.

Figure 6G:
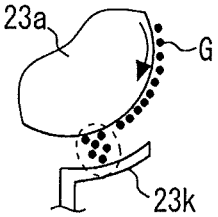
Figure 6H:
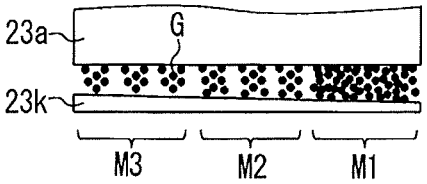

As illustrated in FIGS. 6G and 6H, as the developing roller 23*a* still yet further transports the developer G, the amount of the developer G in the casing gap is saturated in the range M1 having widest casing gap at a timing different from the ranges M2 and M3. At that time, the developer G saturated in the casing gap is discharged (collected) into the developing device 23 in the range M2, and the pressure in the casing gap decreases. In addition, the amount of the developer G in the casing gap is not yet saturated in the ranges M3. Accordingly, the pressure in the casing gap increases in the range M1 but does not increase in the ranges M2 and M3.

With such a configuration, the casing gap gradually decreases (or increases) along the longitudinal direction of the developing device 23. The respective timings at which the amount of the developer G is saturated in the ranges M1 to M3 do not coincide with each other but are shifted in the ranges M1 to M3 in the longitudinal direction each other. That is, timings at which pressure accumulation by stagnation of the developer G and pressure release by discharge of the developer G are repeated are shifted each other in the ranges M1 to M3 in the longitudinal direction of the developing device 23.

Therefore, the pressures in the casing gap, with which the developer G presses the developing roller 23*a*, do not coincide with each other but are shifted in the ranges M1 to M3 in the longitudinal direction each other. In addition, since the pressure is not the resultant force of the pressures in the ranges M1 to M3, the pressure is not enough to displace (vibrate) the developing roller 23*a*.

Note that, in FIGS. 6B, 6D, 6F, and 6H, the casing gap is divided into three ranges M1 to M3 in the longitudinal direction of the developing device 23 for the sake of simplicity. However, since the casing gap continuously changes along the longitudinal direction of the developing device 23, the above-described phenomenon occurs in continuously divided ranges in the longitudinal direction.

FIGS. 7A to 7H are schematic views illustrating motions of developer G passing through a casing gap of a comparative developing device 23 in which the casing gap between the developing roller 23*a* and a lower casing 123*k* is approximately constant in the longitudinal direction.

Figure 7A:
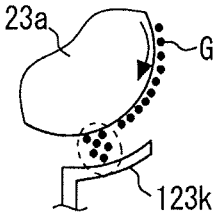
FIGS. 7A to 7H are schematic views illustrating motions of developer passing through a casing gap of a comparative developing device.
Figure 7B:
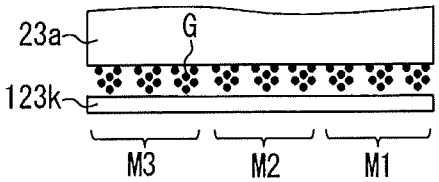

As illustrated in FIGS. 7A and 7B, the developer G does not fully accumulate in the casing gap immediately after the developing device 23 starts operation. As the developer G is transported to the casing gap by the developing roller 23*a*, the amount of the developer G in the casing gap gradually accumulates at the position of the magnetic pole enclosed by dashed line in FIG. 7A. Specifically, as the developer G is drawn to the magnetic pole and conveyance force of the developer G is lowered, the developer G accumulates at the position of the magnetic pole. At that time, since the amount of the developer G is not saturated in the casing gap, the pressure with which the developer G presses the developing roller 23*a* is not generated.

Figure 7C:
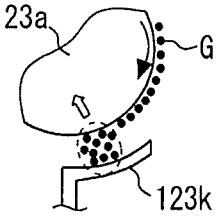
Figure 7D:
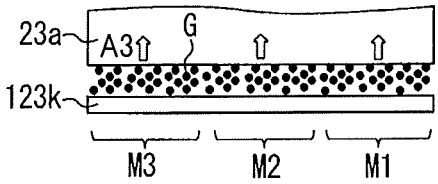

As illustrated in FIGS. 7C and 7D, as the developer G is further transported to the casing gap by the developing roller 23*a*, and the saturation of the amount of the developer G in the casing gap progresses, the pressure is gradually generated, with which the developer G presses the developing roller 23*a* (i.e., the pressure in the casing gap) as indicated by white arrows A3.

Figure 7E:
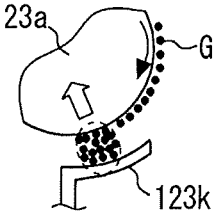
Figure 7F:
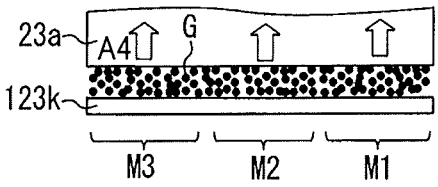

As illustrated in FIGS. 7E and 7F, as the developer G is yet further transported to the casing gap by the developing roller 23*a*, the amount of the developer G in the casing gap further increases. Accordingly, the strong pressure is generated, with which the developer G presses the developing roller 23*a* as indicated by white arrows A4. This pressure displaces the developing roller 23*a* in the direction indicated by white arrows A4.

Figure 7G:
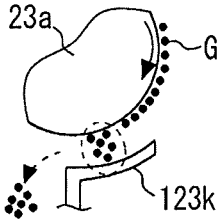
Figure 7H:
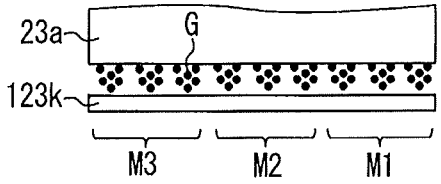

Subsequently, as the developer G is still yet further transported to the casing gap by the developing roller 23*a* as illustrated in FIGS. 7G and 7H, the developer G accumulated in the casing gap is discharged (collected) into the developing device 23 at a burst. Accordingly, the pressure in the casing gap sharply decreases. Then, the developing roller 23*a* returns to the original position as a result of the pressure release.

By repeating such an operation cyclically, the developing roller 23*a* vibrates at a constant frequency.

In the case in which the casing gap gradually decreases and then gradually increases (or gradually increases and then gradually decreases) along the longitudinal direction of the developing device 23, or the casing gap gradually decreases (or gradually increases) stepwise in the longitudinal direction of the developing device 23, such a vibration of the developing roller 23*a* is generated. The effect in the case in which the casing gap continuously decreases (or continuously increases) in the longitudinal direction is not attained.

Figure 8:
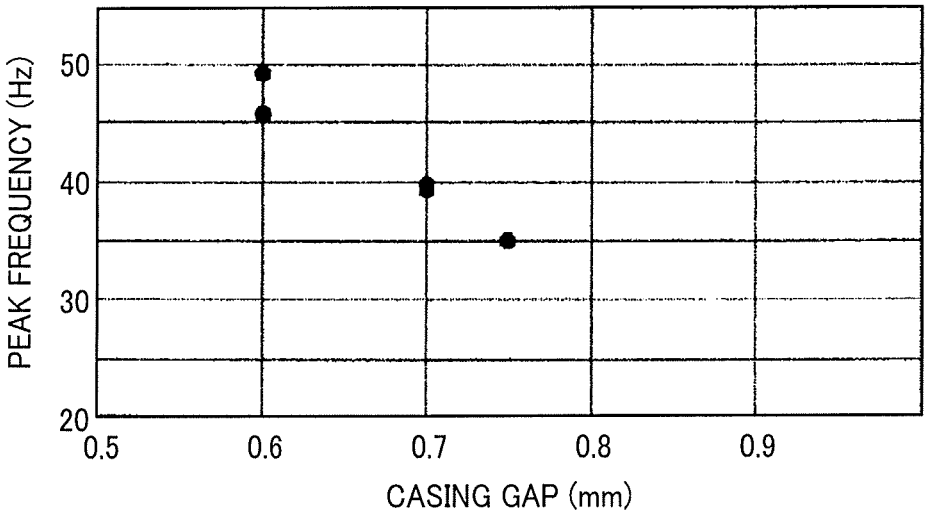
FIG. 8 is a graph illustrating a relation between the casing gap and a peak frequency of vibration of a developing roller of the comparative developing device.

FIG. 8 is a graph illustrating the relation between the casing gap and peak frequency of vibration of the developing roller 23*a* according to the comparative developing device 23 in which the casing gap between the developing roller 23*a* and a lower casing 123*k* is approximately constant in the longitudinal direction of the developing device 23.

An eddy current displacement sensor (manufactured by KEYENCE CORPORATION) was installed at a position facing the developing roller 23*a*, displacement of the developing roller 23*a* was measured, frequency analysis was performed, and peak frequency of vibration of the developing roller 23*a* was calculated. The calculation results are illustrated in FIG. 8.

As the experimental result illustrated in FIG. 8, there is a correlation between the casing gap and the peak frequency of vibration of the developing roller 23*a* that the peak frequency increases as the casing gap decreases. The amount of the developer G in the casing gap and the size (volume) of the casing gap are factors that determine the frequency of vibration of the developing roller 23*a*. It is considered that the frequency of vibration of the developing roller 23*a* changes depending on the amount of the developer G transported for a certain time with respect to the size of the casing gap. Therefore, the amount of the developer G regulated by the doctor blade 23*c* on the developing roller 23*a* (the amount of the developer scooped) may be also the factor that determines the frequency of vibration of the developing roller 23*a*.

Figure 9A:
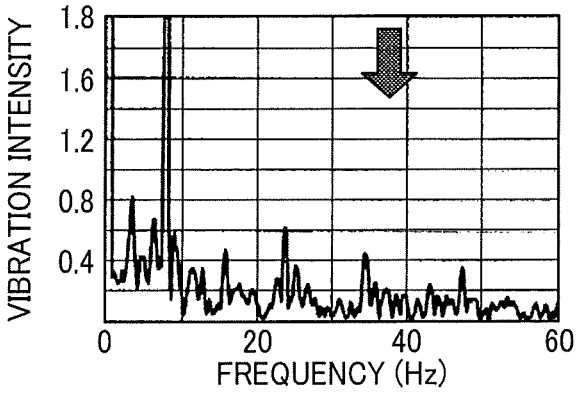
FIGS. 9A and 9B are graphs illustrating a relation between a frequency of vibration of the developing roller and a vibration intensity of the developing roller.
Figure 9B:
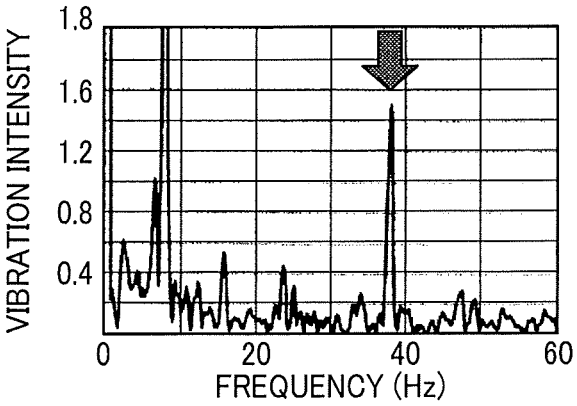

FIG. 9A is a graph illustrating the relation between the frequency of vibration of the developing roller 23*a* and an amplitude of vibration of the developing roller 23*a* (i.e., a vibration intensity) in the developing device 23 according to the present embodiment. The casing gap H1 at the first end is 0.8 mm, and the casing gap H2 at the second end is 0.7 mm in the developing device 23 according to the present embodiment. FIG. 9B is a graph illustrating the relation between the frequency of vibration of the developing roller 23*a* and an amplitude of vibration of the developing roller 23*a* (i.e., the vibration intensity) in the comparative developing device 23. The casing gap is 0.7 mm throughout the longitudinal direction of the developing device 23.

The peaks at frequency of about 38 Hz indicate the vibration intensity generated due to the stagnation and discharge of the developer G in FIGS. 9A and 9B. If the vibration intensity is 0.6 or less, the cyclic density difference (horizontal band with pitch) is not generated in images.

The above-described effect according to the present embodiment can be attained as illustrated in FIGS. 9A and 9B.

In the developing device 23 according to the present embodiment, the difference (H1−H2) between the casing gap H1 and the casing gap H2 is 0.1 mm. The casing gap H1 is the maximum gap between the developing roller 23*a* and the lower casing 23*k* at the first end of the developing device 23 in the longitudinal direction. The casing gap H2 is the minimum gap between the developing roller 23*a* and the lower casing 23*k* at the second end of the developing device 23 in the longitudinal direction.

Specifically, in the present embodiment, the casing gap H1 at the first end is 0.8 mm, the casing gap H2 at the second end is 0.7 mm, and the difference between the casing gap H1 and the casing gap H2 is 0.1 mm.

Figure 10:
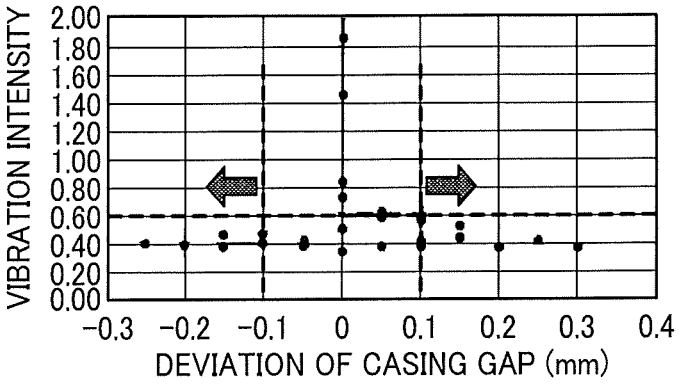
FIG. 10 is a graph illustrating a relation between a deviation of the casing gap and the vibration intensity of the developing roller.

FIG. 10 is a graph illustrating the relation between the deviation of the casing gap and the vibration intensity of the developing roller 23*a*. The deviation of the casing gap is the difference of the casing gap in the whole longitudinal direction from the first end to the second end of the developing device 23.

FIG. 10 illustrates the experimental result in which the vibration intensity of the developing roller 23*a* was measured when the deviation of the casing gap was changed in the image forming apparatus 1 according to the present embodiment. As the experimental result illustrated in FIG. 10, if the deviation of the casing gap is 0.1 mm or more, the vibration intensity of the developing roller 23*a* becomes 0.6 or less, thereby preventing the cyclic density difference (horizontal band with pitch).

Referring to FIGS. 4B and 5, in the developing device 23 according to the present embodiment, an upstream side of the second conveying screw 23*b*2 in the conveyance direction of the developer G corresponds to the side with the wide casing gap H1, and a downstream side of the second conveying screw 23*b*2 in the conveyance direction of the developer G corresponds to the side with the narrow casing gap H2.

In other words, the second conveying screw 23*b*2 as the second conveyor transports the developer G separated from the developing roller 23*a*, from the first end of the developing device 23 (right side in FIGS. 4B and 5) to the second end of the developing device 23 (left side in FIGS. 4B and 5) in the longitudinal direction of the developing device 23 as indicated by dashed arrow in FIG. 5. The casing gap H1 at the first end of the developing device 23 (right side in FIG. 5) is wide, and the casing gap H2 at the second end of the developing device 23 (left side in FIG. 5) is narrow in the longitudinal direction of the developing device 23.

The suction airflow is weak at the first end with the wide casing gap H1 (right side in FIG. 5) as compared with the second end with the narrow casing gap H2 (left side in FIG. 5). However, since an internal pressure of the developing device 23 decreases on the upstream side of the second conveying screw 23*b*2, toner hardly erupts from the casing gap at the first end in the longitudinal direction of the developing device 23.

A further detailed description is given of the airflow of the developing device 23.

The first, second, and third conveying screws 23*b*1 to 23*b*3 in the developing device 23 transport air along with the developer G. Therefore, an internal pressure in an upstream side of the second conveyance compartment B2 is likely to be lower than an internal pressure in the downstream side of the second conveyance compartment B2 in the developer conveyance direction. In the second conveyance compartment B2 in which the second conveying screw 23*b*2 is disposed (the conveyance compartment adjoining the casing gap), the internal pressure is low at the first end (right side in FIG. 5) as compared with the second end (left side in FIG. 5) in the longitudinal direction of the developing device 23. Therefore, the developing device 23 sucks a lot of air at the first end (right side in FIG. 5) through the casing gap as compared with the second end (left side in FIG. 5) in the longitudinal direction of the developing device 23. Such a distribution of the internal pressure cancels reduction of the suction airflow due to the wide casing gap H1, thereby generating the desired suction airflow. As a result, the developing device 23 satisfactorily sucks toner scattering around the development range, thereby minimizing toner scattering.

Figure 11:
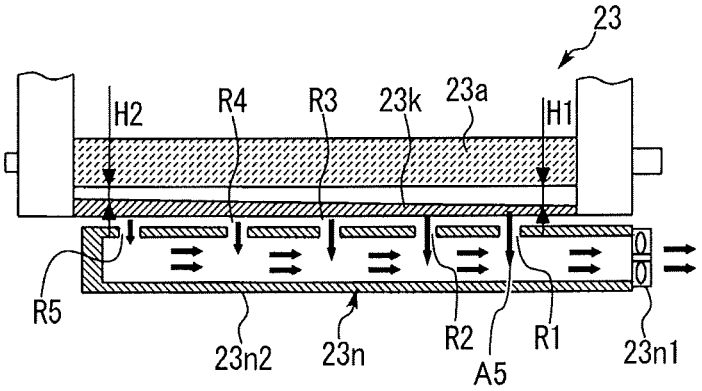
FIG. 11 is a schematic view illustrating a developing roller, a lower casing, and a suction device of the developing device, viewed along a longitudinal direction of the developing device.

As illustrated in FIG. 11 (and FIG. 3), in the developing device 23 according to the present embodiment, the suction device 23*n* to suck air around the development range is disposed downstream from the developing range, in which the developing roller 23*a* is opposed to the photoconductor drum 21, in the rotation direction of the developing roller 23*a*.

In the suction device 23*n*, a suction power at the second end with the narrow casing gap H2 (left side in FIG. 11) is weaker than a suction power at the first end with the wide casing gap H1 (right side in FIG. 11).

Specifically, the suction device 23*n* includes multiple suction ports R1 to R5, a duct 23*n*2 on which an exhaust port is disposed, and a suction fan 23*n*1 is attached to the exhaust port of the duct 23*n*2 via a toner filter. The suction device 23*n* sucks toner scattering around the development range through the suction ports R1 to R5 by the suction fan 23*n*1, and the toner filter of the duct 23*n*2 collects the sucked scattering toner.

Since the suction fan 23*n*1 is disposed at the first end of the developing device 23 (right side of the duct 23*n*2 in FIG. 11), the suction ports R1 to R5 have stronger suction power in order of closeness to the suction fan 23*n*1 as illustrated by arrow A5 in FIG. 11 (i.e., in order of R1, R2, R3, R4, and R5).

In the present embodiment, the suction airflow of the casing gap is weak at the first end with the wide casing gap H1 (right side in FIG. 11) as compared with the second end with the narrow casing gap H2 (left side in FIG. 11), and toner scattering is likely to occur at the first end with the wide casing gap H1. However, the distribution of the suction power of the suction device 23*n*, which is stronger at the first end (right side in FIG. 11), cancels the weak suction airflow at the first end, thereby minimizing the toner scattering.

Figure 12:
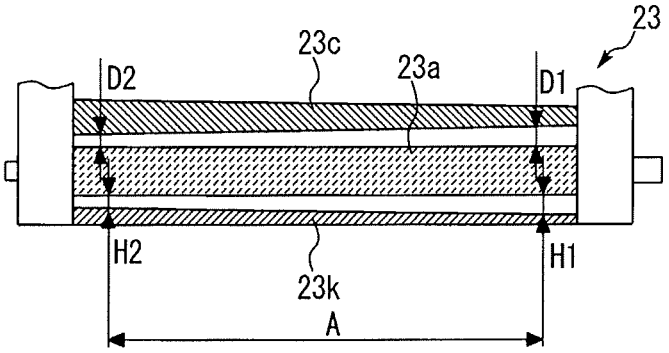
FIG. 12 is a schematic view illustrating a developing roller, a lower casing, and a doctor blade of the developing device according to a first variation of the present disclosure, viewed along a longitudinal direction of the developing device.

FIG. 12 is a schematic view illustrating a developing roller 23*a*, the lower casing 23*k*, and a doctor blade 23*c* of the developing device 23 according to a first variation of the present disclosure, as viewed along the longitudinal direction of the developing device 23. This schematic view corresponds to FIG. 5 which illustrates the above-described embodiment.

Referring to FIG. 12, in the developing device 23 according to the first variation, a doctor gap between the developing roller 23*a* and the doctor blade 23*c* (the developer regulator) changes from the first end of the developing device 23 to the second end of the developing device 23 in the longitudinal direction of the developing device 23 at a rate smaller than the rate (H1−H2)/A at which the casing gap continuously decreases (or increases). Specifically, in FIG. 12, the doctor blade 23*c* is provided so that the rate (D1−D2)/A at which the doctor gap continuously decreases is smaller than the rate (H1−H2)/A at which the casing gap continuously decreases (i.e., (H1−H2)/A>(D1−D2)/A).

As described above, since the casing gap continuously decreases or increases, the vibration of the developing roller 23*a* is minimized. Since the stagnation and discharge of the developer G in the casing gap cause the vibration of the developing roller 23*a*, the amount of the developer G supplied to the casing gap (supply rate) is factor of the vibration of the developing roller 23*a*. Therefore, in the case of the casing gap that gradually decreases or increases, if the developer G is excessively supplied to the casing gap, the developing roller 23*a* receives pressing force by the developer G in the casing gap, causing the vibration of the developing roller 23*a*.

In the first variation, the deviation (slope) of the casing gap is greater than the deviation (slope) of the doctor gap. Therefore, if the amount of the developer G supplied to the casing gap is not uniform in the longitudinal direction of the developing device 23, the timing of stagnation and discharge of the developer G in the casing gap is shifted in the longitudinal direction, thereby minimizing the vibration of the developing roller 23*a*.

Note that, the doctor gap may discontinuously vary in the longitudinal direction due to the component error or the assembly error of the doctor blade 23*c*. In such a case, if above-described condition of the rate at which the doctor gap changes in the longitudinal direction is satisfied by the selection of the doctor blade 23*c* or improvement of assembly accuracy of the doctor blade 23*c*, the vibration of the developing roller 23*a* can be minimized.

Figure 13:
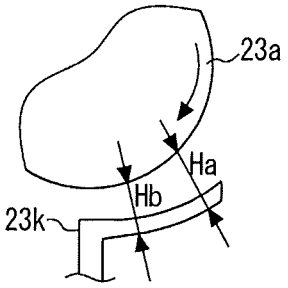
FIG. 13 is an enlarged cross-sectional view illustrating a developing roller and a lower casing of the developing device according to a second variation of the present disclosure.

FIG. 13 is an enlarged cross-sectional view illustrating a developing roller 23*a* and the lower casing 23*k* of the developing device 23 according to a second variation of the present disclosure.

As illustrated in FIG. 13, in the developing device 23 according to the second variation, a casing gap Ha between the developing roller 23*a* (the developer bearer) and the lower casing 23*k* on the upstream side is greater than a casing gap Hb on the downstream side in the rotation direction of the developing roller 23*a* (i.e., Ha>Hb). Note that, in the present embodiment both the casing gap Hb on the downstream side and the casing gap Ha on the upstream side in the rotation direction of the developing roller 23*a* gradually decrease from the first end to the second end in the longitudinal direction of the developing device 23 at similar rate.

With such a configuration, volume of the casing gap can be expanded overall, and the casing gap is hardly clogged with the developer G. Accordingly, the pressure against the developing roller 23*a* can be reduced. As a result, the vibration of the developing roller 23*a* can be minimized.

In the above-described embodiments, the developing device 23 (the process cartridge 20) includes the lower casing 23*k* as a casing opposed to the developing roller 23*a* as a developer bearer at a position downstream from the developing range (an opposed position), in which the developing roller 23*a* is opposed to the photoconductor drum 21, in the rotation direction of the developing roller 23*a*. The casing gap between the developing roller 23*a* and the lower casing 23*k* continuously decreases (or increases) from the first end of the developing device 23 to the second end of the developing device 23 across the center of the developing device 23 in the longitudinal direction of the developing device 23.

Therefore, the developing roller 23*a* hardly receives cyclic force in the casing gap between the developing roller 23*a* and the lower casing 23*k*.

It is to be noted that the descriptions above concern the developing device 23 employing two-component developing and configured to receive the two-component developer G supplied from the developer container 28. However, aspects of the present disclosure are applicable to a developing device employing two-component developing and configured to receive toner T supplied from a toner container solely containing toner T.

It is to be noted that the descriptions above concern the developing device 23 employing two-component developing and configured to contain the two-component developer G including toner T and carrier C. However, aspects of the present disclosure are applicable to a developing device containing one-component developer (i.e., toner T) and employing one-component developing.

Additionally, although the descriptions above concern the developing device 23 including the single developing roller 23*a* (the developer bearer). However, aspects of the present disclosure are applicable to a developing device including two or more developer bearers.

Further, in the above-described embodiments, aspects of the present disclosure are applied to the developing device 23 including three conveyance compartments B1 to B3 (the first, second, and third conveying screws 23*b*1 to 23*b*3) extending in the longitudinal direction of the developing device 23. However, aspects of the present disclosure are applicable to a developing device including two, or four or more conveyance compartments (the conveying screws) or a developing device including a conveyor such as a conveying paddle that stirs and transports the developer unlike the conveying screw that proactively transports the developer in the longitudinal direction of the developing device.

In such configurations, similar effects to the above-described embodiments are also attained.

In the embodiments described above, the photoconductor drum 21 as the image bearer, the charger 22, the developing device 23, and the cleaner 25 are united as the single process cartridge 20. However, the present disclosure is not limited to the embodiments described above and applied to the image forming apparatus in which all or a part of above-describe components (i.e., the photoconductor drum 21 as the image bearer, the charger 22, the developing device 23, and the cleaner 25) are removably installed as a single unit, respectively. In such configurations, similar effects to the embodiments described above are also attained.

It is to be noted that the term "process cartridge" used in the present disclosure means a unit including an image bearer and at least one of a charger to charge the image bearer, a developing device to develop latent images on the image bearer, and a cleaner to clean the image bearer united together and is designed to be removably installed together in the apparatus body of the image forming apparatus.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components described above are not limited to those embodiments described above. Desirable number, position, and shape can be determined to perform the present disclosure.

What is claimed is:

1. A developing device comprising:

a developer bearer opposed to an image bearer and configured to bear developer, rotate in a direction of rotation of the developer bearer, and develop a latent image formed on a surface of the image bearer; and a casing opposed to the developer bearer at a position downstream from an opposed position, at which the developer bearer is opposed to the image bearer, in the direction of rotation of the developer bearer, a casing gap between the developer bearer and the casing which is one of continuously decreasing and continuously increasing from a first end of the developing device to a second end of the developing device across a center of the developing device in a longitudinal direction of the developing device.

2. The developing device according to claim 1, further comprising a developer regulator opposed to the developer bearer at a position upstream from the opposed position in the direction of rotation of the developer bearer and configured to adjust an amount of the developer on the developer bearer, wherein a doctor gap between the developer bearer and the developer regulator is constant in the longitudinal direction of the developing device or changes at a rate smaller than a rate at which the casing gap between the developer bearer and the casing continuously decreases or increases from the first end of the developing device to the second end of the developing device in the longitudinal direction of the developing device.

3. The developing device according to claim 1, wherein a difference between the casing gap at the first end of the developing device and the casing gap at the second end of the developing device is 0.1 mm or more.

4. The developing device according to claim 1, further comprising:

a first conveyor opposed to the developer bearer and configured to transport the developer in the longitudinal direction of the developing device and supply the developer to the developer bearer; and a second conveyor opposed to the developer bearer and the first conveyor and configured to transport a portion of the developer that has been supplied to and separated from the developer bearer, from the first end of the developing device to the second end of the developing device in the longitudinal direction of the developing device wherein the casing gap between the developer bearer and the casing continuously decreases from the first end of the developing device to the second end of the developing device in the longitudinal direction of the developing device.

5. The developing device according to claim 1, further comprising a suction device disposed downstream from the opposed position in the direction of rotation of the developer bearer and configured to suck air around the opposed position, wherein the suction device has a suction power that is smaller at the second end of the developing device than at the first end of the developing device, and wherein the casing gap between the developer bearer and the casing continuously decreases from the first end of the developing device to the second end of the developing device in the longitudinal direction of the developing device.

6. The developing device according to claim 1, wherein the casing gap between the developer bearer and the casing is greater on an upstream side than on a downstream side in the direction of rotation of the developer bearer.

7. A process cartridge comprising:

the developing device according to claim 1; and the image bearer united with the developing device in the process cartridge, wherein the process cartridge is removable from and installable in an image forming apparatus.

8. An image forming apparatus comprising:

the developing device according to claim 1; and the image bearer.

9. A device comprising:

a developer roller opposed to a photoconductive surface and to bear developer, rotate in a direction of rotation of the developer roller, and develop a latent image on the photoconductive surface; and a casing opposed to the developer roller at a position downstream from an opposed position, at which the developer roller is opposed to the photoconductive surface, in the direction of rotation of the developer roller, a casing gap between the developer roller and the casing continuously decreasing from a first end of the device to a second end of the device across a center of the device in a longitudinal direction of the device.

10. The device according to claim 9, further comprising a blade opposed to the developer roller at a position upstream from the opposed position in the direction of rotation of the developer roller and to adjust an amount of the developer on the developer roller, wherein a doctor gap between the developer roller and the blade is constant in the longitudinal direction of the device or changes at a rate smaller than a rate at which the casing gap between the developer roller and the casing continuously decreases from the first end of the device to the second end of the device in the longitudinal direction of the device.

11. The device according to claim 9, wherein a difference between the casing gap at the first end of the device and the casing gap at the second end of the device is 0.1 mm or more.

12. The device according to claim 9, further comprising:

a first conveyor opposed to the developer roller and configured to transport the developer in the longitudinal direction of the device and supply the developer to the developer roller; and a second conveyor opposed to the developer roller and the first conveyor and configured to transport a portion of the developer that has been supplied to and separated from the developer roller, from the first end of the device to the second end of the device in the longitudinal direction of the device.

13. The device according to claim 9, further comprising a plurality of suction ports disposed downstream from the opposed position in the direction of rotation of the developer roller and configured to suck air around the opposed position, wherein one of the suction ports at the second end of the device has a suction power that is smaller than one of the suction ports at the first end of the device.

14. The device according to claim 9, wherein the casing gap between the developer roller and the casing is greater on an upstream side than on a downstream side in the direction of rotation of the developer roller.

15. A process cartridge comprising:

the device according to claim 9; and the photoconductive surface united with the device in the process cartridge, wherein the process cartridge is removable from and installable in an image forming apparatus.

16. An image forming apparatus comprising:

the device according to claim 9; and the photoconductive surface.

* * * * *